United States Patent [19]

Taylor

[11] 4,187,038

[45] Feb. 5, 1980

[54] EQUIPMENT FOR EXTRACTING OIL OR GAS FROM UNDER THE SEA BED AND METHOD OF INSTALLING SUCH EQUIPMENT

[75] Inventor: Reginald S. Taylor, Gerrards Cross, England

[73] Assignee: Taylor Woodrow Construction Limited, Middlesex, England

[21] Appl. No.: 828,864

[22] Filed: Aug. 29, 1977

[30] Foreign Application Priority Data

Aug. 27, 1976 [GB] United Kingdom ..... 35844/76

[51] Int. Cl.[2] ..... E02D 25/00

[52] U.S. Cl. ..... 405/204; 405/195

[58] Field of Search ..... 61/87, 88, 89, 92, 94, 61/96, 34, 90, 91, 98

[56] References Cited

U.S. PATENT DOCUMENTS

| | | | |
|---|---|---|---|
| 2,600,761 | 6/1952 | Halliburton | 61/91 |
| 2,873,581 | 2/1959 | Hazak | 61/92 |
| 2,908,142 | 10/1959 | Suderow | 61/91 |
| 3,091,089 | 5/1963 | Gellerstad | 61/96 |
| 3,138,932 | 6/1964 | Kofahl et al. | 61/87 |
| 3,624,702 | 11/1971 | Meheen | 61/96 |
| 4,026,227 | 5/1977 | Cohn et al. | 61/87 |
| 4,038,830 | 8/1977 | Sumner | 61/89 |

FOREIGN PATENT DOCUMENTS

| | | | |
|---|---|---|---|
| 209196 | 10/1959 | Austria | 61/90 |
| 1020555 | 2/1966 | United Kingdom | 61/89 |
| 1334342 | 10/1973 | United Kingdom | 61/98 |

*Primary Examiner*—Denis L. Taylor

*Attorney, Agent, or Firm*—Armstrong, Nikaido, Marmelstein & Kubovcik

[57] ABSTRACT

A method of, and equipment for, providing at the sea bed at a deep water site an installation for extracting oil or gas and comprising an anchored base structure and a column extending from the base structure to above the surface and made up of telescopically arranged column sections.

15 Claims, 12 Drawing Figures

Figure 1:
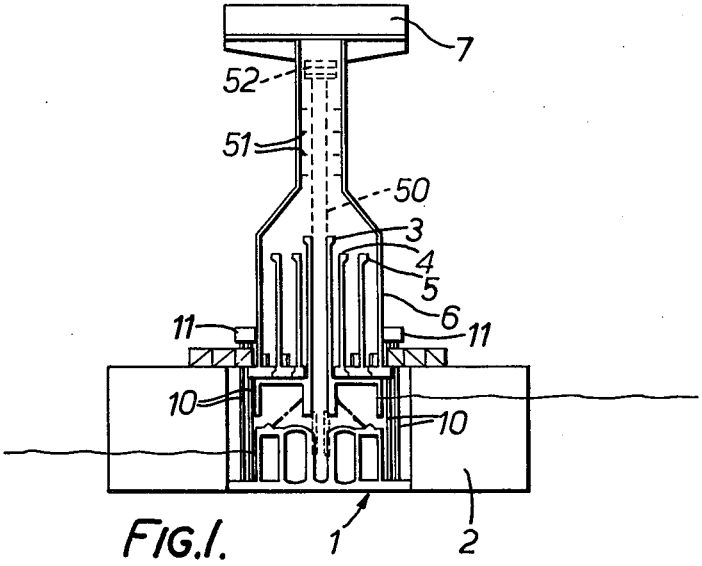

EQUIPMENT FOR EXTRACTING OIL OR GAS FROM UNDER THE SEA BED AND METHOD OF INSTALLING SUCH EQUIPMENT

This invention relates to the extraction of oil and gas from under the sea bed at deep water sites and in particular to a method of providing an installation for such extraction, to an installation itself and to equipment adapted to form such an installation.

It has been proposed to provide such an installation comprising a concrete structure anchored to the sea bed so as to be below the water surface and carrying a column which extends to above the surface, the column being manufactured as a single hollow tubular column which is transported to the site in a generally horizontal disposition, one end then being lowered with the concrete structure or onto a pre-positioned concrete structure; the column thus ends up vertical with its upper end above the surface and its lower end connected to the concrete structure.

According to one aspect of the present invention, there is provided a method of providing an installation for extracting oil or gas from under the sea bed at a deep water site, which installation conprises a base structure anchored to the sea bed so as to be below the surface and a column which extends from the base structure to above the surface, the column being in the form of a hollow tube for accommodating conductors for oil or gas extending from the sea bed, through the base structure and the column to above the surface, the method comprising constructing at a dry or relatively shallow water site the base structure and at least two elongate hollow column sections arranged telescopically one within the other and providing the base structure and the column sections with sufficient bouyancy for them to float; floating and transporting the base structure and the column sections to a deep water site; sinking the base structure and in upright position one or more of the column sections relative to the column section that is uppermost; and anchoring the base structure to the sea bed; the column sections being joined to each other and to the base structure to form a column connected to the base structure, with the joint between each two adjacent column sections comprising overlapping portions of these two sections defining an annular gap which is filled with fast setting cementacious material.

In the method just set forth column sections can be floated to the deep water site and sunk whilst separated from the base structure and thereafter joined to the base structure. Alternatively the column sections can be joined to the base structure at the construction stage so as to be vertically oriented and disposed above the base structure and the resulting assembly transported to the deep water site floating in this relative disposition. Preferably the column section destined to form the top of the column carries a working platform.

The base structure can be directly anchored to the sea bed, or can be secured to a further structure already anchored to the sea bed.

According to another aspect of the invention, there is provided equipment adapted to form an installation for extracting oil or gas from under the sea bed at a deep water site, the equipment, comprising a base structure and at least two elongate hollow columns sections arranged telescopically, one within the other the base structure and the column sections being provided with sufficient bouyancy for them to float, the column sections being provided at a dry or relatively shallow water site at which they are constructed with sufficient buoyancy for them to float, the column sections being adapted so that one or more of them can move down relative to an upper one and so that the column sections can be joined together at their end regions to form a column, the installation being placeable at a deep water site by floating and transporting the base structure and the columns to this site from said dry or relatively shallow water site; sinking the base structure and in upright position one or more of the column sections relative to the column section that is uppermost; and anchoring the base structure to the sea bed; the column sections being joined to each other and to the base structure to form a column connected to the base structure with the joint between each two adjacent column sections comprising overlapping portions of these two sections defining an annular gap which is filled with fast setting cementacious material.

The buoyancy is preferably provided as a separate entity, the base structure and column sections being firmly attached to the buoyancy for transportation and, when at the deep water site, the buoyancy providing a working raft to remain at the water surface and support the base structure and column sections until such time as they are anchored or at least themselves floating in stable equilibrium, so that the buoyancy can be removed.

The base structure, the column sections and the buoyancy are adapted so that during installation at the deep water site as each column section is successively lowered relative to that which will be disposed above it in the final column, the joint which is made between the upper end region of the column section just lowered and the lower end region of the next section is made above the water level; this makes working conditions far more practical than if the joining operations had to be carried out below the surface.

The base structure preferably contains floodable chambers to permit, in the case in which the column sections are initially joined to the base structure and lowering the base structure and the or each successive column section relative to the upper column section is achieved by introducing water into them to the required amount so that they just sink to the appropriate level. This could be achieved by suitable valves in the base structure operable from the buoyancy raft or by pumps located in the base structure or more desirably on the buoyancy raft; clearly it would be important to provide the facility to extract water if at any time during the procedure it became necessary to raise slightly the base structure and any lowered column sections.

The column sections will comprise prestressed concrete tubes which are preferably cylindrical but may be tapered, the number and length of the tubes being determined by the depth of water through where the column is to extend. The innermost tube will be the one connected to the base structure and the outermost will be the upper one extending above the surface. With this arrangement the final column will comprise the column sections of successively increasing diameter in the upward direction. It would, of course, be possible to provide for the column to be tapering in the upward direction by arranging for the largest diameter tube to be lowered first with the base structure, then the next biggest section and so on so that the smallest diameter column member forms the top of the column.

Figure 8:
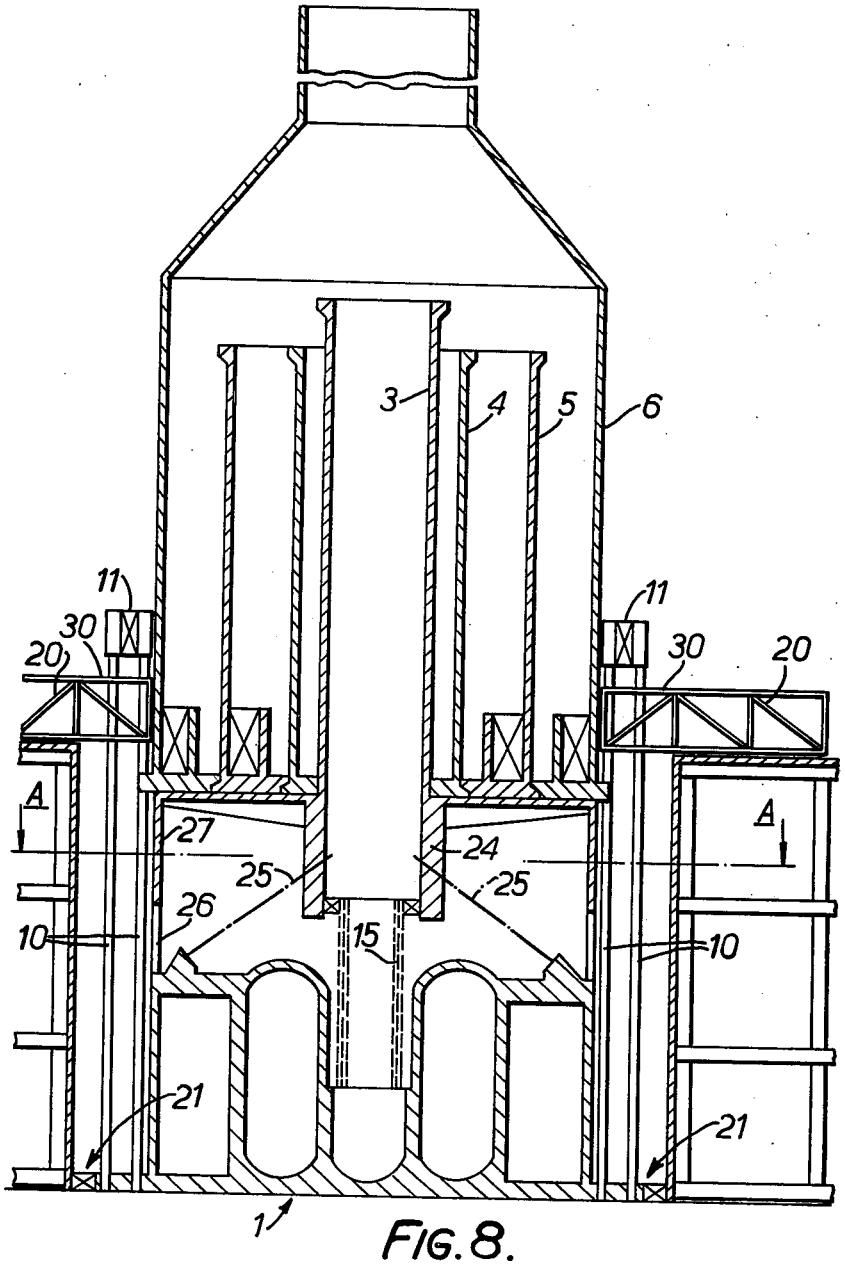
Figure 9:
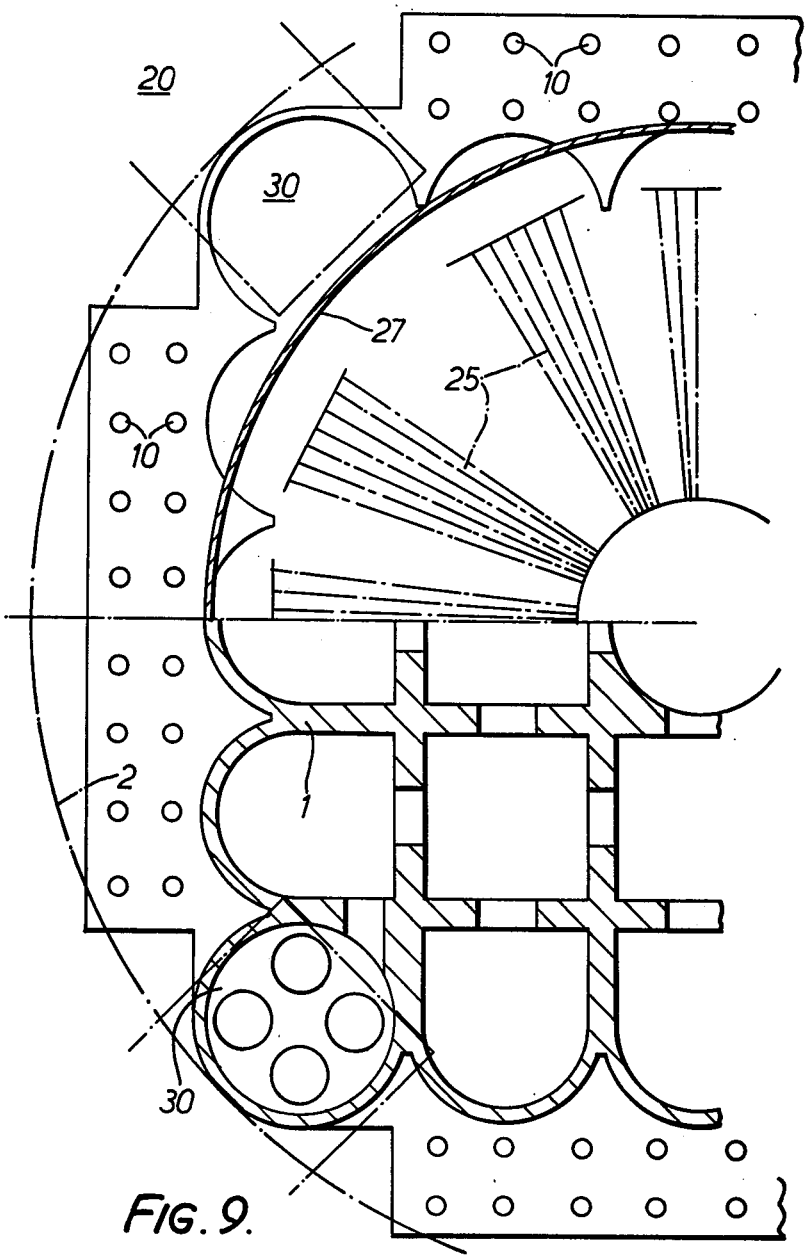

For a better understanding of the invention and to show how the same may be carried into effect, reference will now be made, by way of example only, to the accompanying drawings, in which:

FIG. 1 shows equipment adapted to form an installation for extracting oil or gas from under the sea bed, in a condition ready for being towed to a deep water site, FIGS. 2 to 7 shows the successive stages in a method of installing the equipment shown in FIG. 1, FIG. 8 is a vertical section through the equipment of FIG. 1, FIG. 9 is a plan view taken on the line A—A of FIG. 8, and FIGS. 10 to 12 are detail views of parts of the equipment as seen in FIG. 8.

Water depths and other dimensions referred to below are only typical and it will be appreciated that wide variations could be accommodated. In general, by deep water sites is meant water depths around 150–200 m or much more, but the principles of the present invention may be applicable to installations for lesser depths.

Referring first to FIG. 1, the equipment comprises generally a base structure 1 which is constructed as a multi-compartmental housing to house well heads of so-called "subsea completions" that are utilised in the extraction of oil and gas, some of which chambers can be maintained at atmospheric pressure to permit man-access to the completion, a buoyancy raft 2 in the form of an annulus surrounding the base structure 1 and, arranged in a vertical orientation above the base structure 1, a plurality of elongate tubular column sections 3, 4, 5, 6, the outermost, 6, of which extends upwardly above the rest via an inwardly tapering portion to a smaller diameter section the top of which carries a working platform 7 affording a deck and all the modules and ancilliary apparatus which will be required at the installation. All this equipment is constructed in their relative disposition as shown in FIG. 1 but on a dry site within a coffer dam.

The tubular column sections 3, 4, 5, 6, are of successively increasing diameter and are arranged coaxially one within the other the lower ends of the members 4, 5 and 6 lying in a common plane and being secured to each other at their lower ends as will be explained. The inner column section 3 extends downwardly below the others and is connected to the base structure 1.

The base structure 1 which is firmly secured to the buoyancy raft 2 is provided with groups of piles 10 and associated hydraulic pile driving eqipment 11 for eventually fixing the base structure 1 to the sea bed to form a foundation base.

The base structure 1 and the column sections 3 to 6 are made of prestressed reinforced concrete, or perhaps steel, and the buoyancy raft 2 is made of similar concrete material or steel.

When the assembly is completed as far as possible on the dry site, it is ready to be floated out to a deep water site. The coffer dam is breached and the site flooded to a depth sufficient for the assembly to float in the position as shown in the left of FIG. 1. The assembly is then towed to slightly deeper water and the buoyancy ballasted with water so that the assembly floats lower and hence more stably, in the position shown to the right of FIG. 1; it will be noted however that the column sections are vertical and completely above the water surface, but since they are telescoped together inside one another the centre of gravity is relatively low so that the assembly is quite stable. The assembly extends up above the water level by the height of the outer column section 6 which may for example be around 100 m for an eventual installation in water over 200 m deep. The assembly is then towed to the deep water site.

Figure 2:
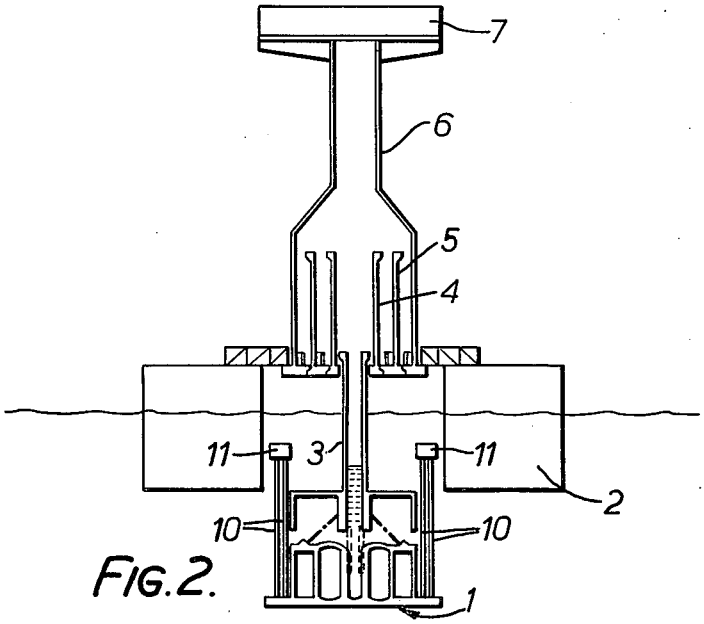
Figure 3:
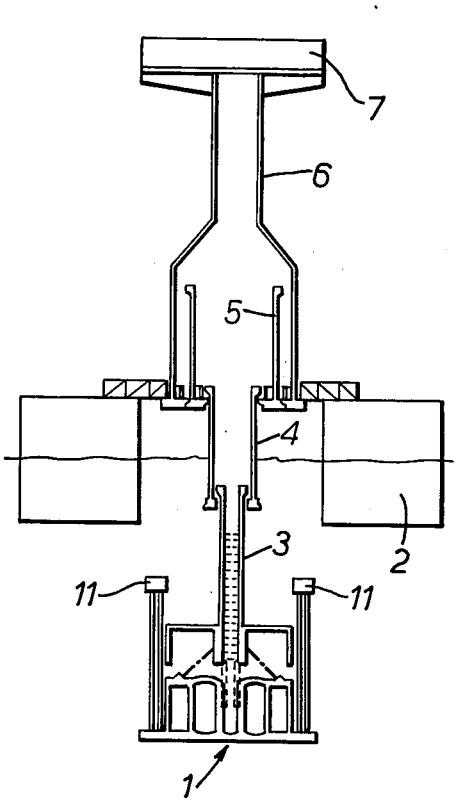
Figure 4:
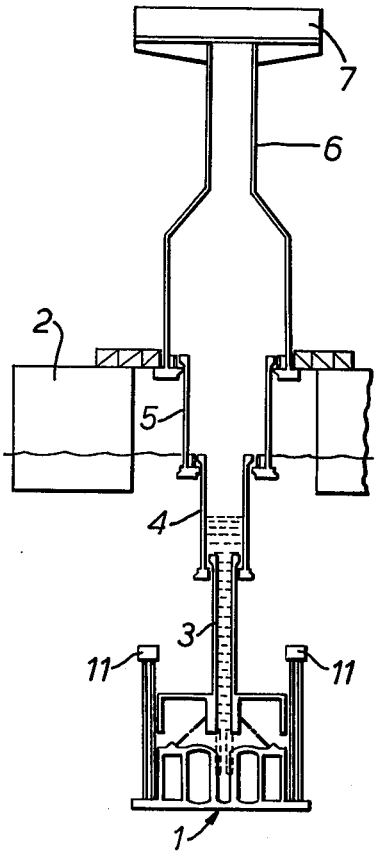

Then follows the successive lowering steps to form the extended column, as shown in FIGS. 2 to 4. First the innermost column section 3 is released from the adjacent section 4, and the base structure 1 is released from the raft 2, or vice versa. Owing to the chambers in the base structure 1 and the hollow interior of the column section 3, the inside of which is in communication with the inside of the base structure via a flexible access connector 15 (see FIG. 8), the base structure 1 and column section 3 will not sink much until they are ballasted with water, introduced via suitable valves or pumps operated from the raft 2, when they will sink down accordingly to a predetermined position shown in FIG. 2. The upper end of the column section 3 now lies adjacent the lower end of the next larger section 4, there being a predetermined overlap in the longitudinal direction. At the overlap a joint is formed to make a rigid connection; this work, it will be noted, is carried out above water level.

With column sections 3 and 4 now rigidly connected, the latter is released from column section 5, further ballast water is introduced and the base structure 1 and sections 3 and 4 sink to the FIG. 3 position. A rigid joint is then made between the overlapping end regions of sections 4 and 5 exactly as that between sections 3 and 4, section 5 is then released from the outer section 6 and more ballast water introduced to bring the assembly to the FIG. 4 position where the last joint is effected between sections 5 and 6, all the joints being made above water level. It will, of course, be appreciated that, for assembly to take place as just described, each column section must have a weight which is less than the combined buoyancy of the base structure 1 and the column section(s) already lowered to ensure that when each successive section is released it can be supported by the floating base structure and column section(s) already extended. Alternatively, additional support can be provided by cables, tendons or jacks operating from a strong-back system at the upper level of the outer section 6.

It will be observed that as the successive column sections are lowered, more of the assembly becomes submerged so that the buoyancy raft floats higher, having to support less weight.

Figure 5:
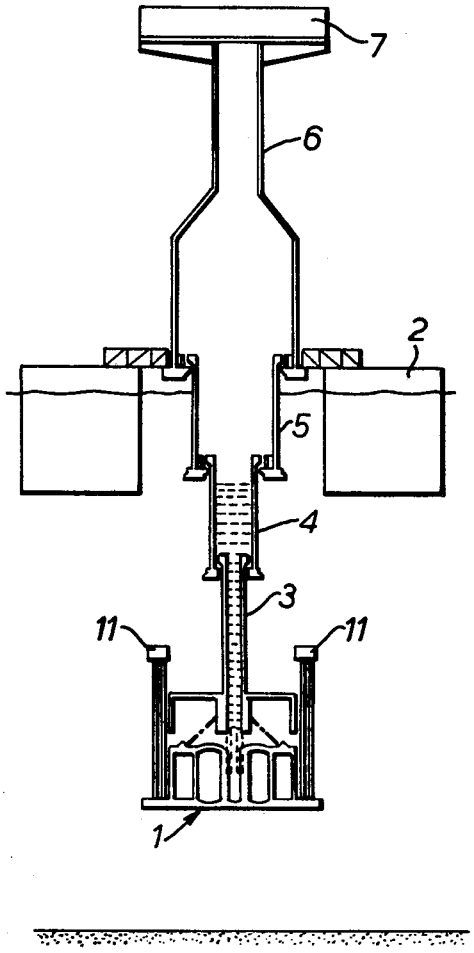

The column sections 3 to 6 now form a rigid column and the assembly is ready for the next stage of lowering it to the sea bed. For this the buoyancy raft 2 is ballasted with water so that the entire raft and assembly sinks a small amount (FIG. 5). This brings the base structure 1 and column 3–6 to a submerged position in which it is self buoyancy without flotation aid from the buoyancy raft 2 but it is in unstable equilibrium with a tendency to invert. However, the buoyancy raft 2 which is still firmly attached to the column section 6 prevents any possibility of inversion.

Figure 6:
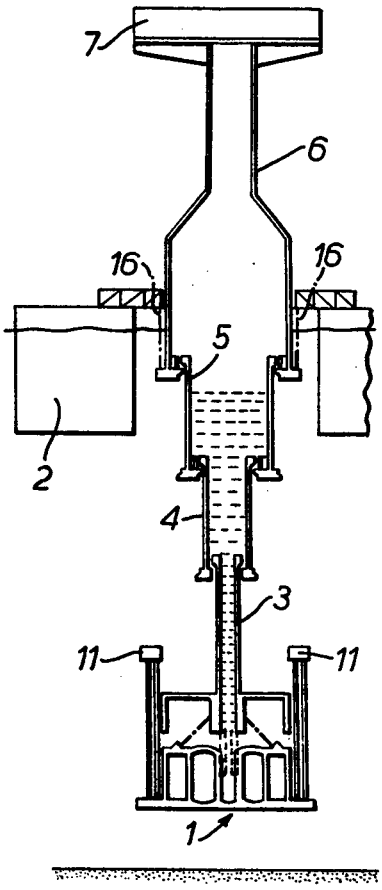
Figure 7:
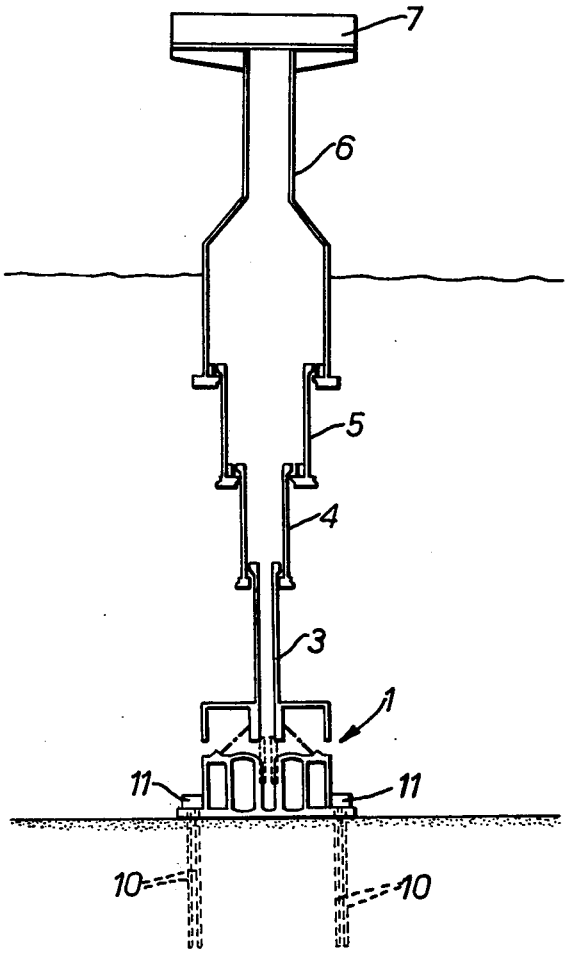

To bring the assembly into stable equilibrium it is further ballasted with water introduced into the column and by means of a winch arrangement 16—see FIG. 6—it is lowered relative to the raft 2. Alternatively ballasting is effected so that the raft and the assembly sink further together. Once in stable equilibrium the raft 2 can be dismantled and removed.

During all these steps from FIG. 2 to FIG. 6 the assembly may be moored or otherwise retained generally in location though it is possible that drifting up to 30–40 ft. could be tolerated.

With the raft 2 removed, the assembly is then gradually lowered by further water ballasting until the base structure 1 rests on and British Pat. No. 1,513,581 that the assembly rests with an effective weight on the sea bed.

The piling machines 11 are then operated to drive the piles 10 into the sea bed. The piling equipment may be of the type forming the subject of our British Pat. No. 966,094 and the procedure as described in our British Pat. No. 1,502,643.

Once piling is complete all the water ballast is pumped out and the joint between the column and base structure is freed.

As an alternative, the base structure can be of the gravity type not requiring piling, in which case once the base structure in on the sea bed ballast is introduced either by flooding compartments in the structure or by adding heavy aggregate material to increase the weight of the structure.

Turning to the more detailed Figures, FIG. 8 shows the raft 2 having a working platform 20 which for the transportation and initial lowering steps is firmly secured to the outer column section 6. At the bottom of the raft 2 hydraulic jacks 21 clamp the base structure 1 firmly to the raft.

FIG. 8 also shows the detailed connection between the innermost column section 3 and the base structure 1, which connection includes the flexible man-access connector 15 and a tendon arrangement 25 which provides an articulated joint between the column and the base structure. When installed the tendons are in tension since the column is buoyant, and they allow movement of the column relative to the base structure 1. This joint will not be described further since it is fully described in our British Pat. No. 1,502,643 and British Pat. No. 1,513,581. For transportation and during this lowering procedure the joint is held completely rigid by a suitable jacking arrangement.

A circumferential "wall" of spaced props 26 is also provided between an outer ring 27 formed integrally with the lower end of the column section 6 and the base structure 1 to held rigidity of the joint during installation.

FIG. 9 shows the generally square plan of the base structure 1 and the surrounding circular raft 2, the position of the piles 10 and the position of four radial extensions 30 of the platform 20 for attachment to the outer column section 6. Other arrangements are possible, it being likely that eight circumferentially spaced sections 30 will be needed with the piling positions appropriately re-arranged.

Figure 10:
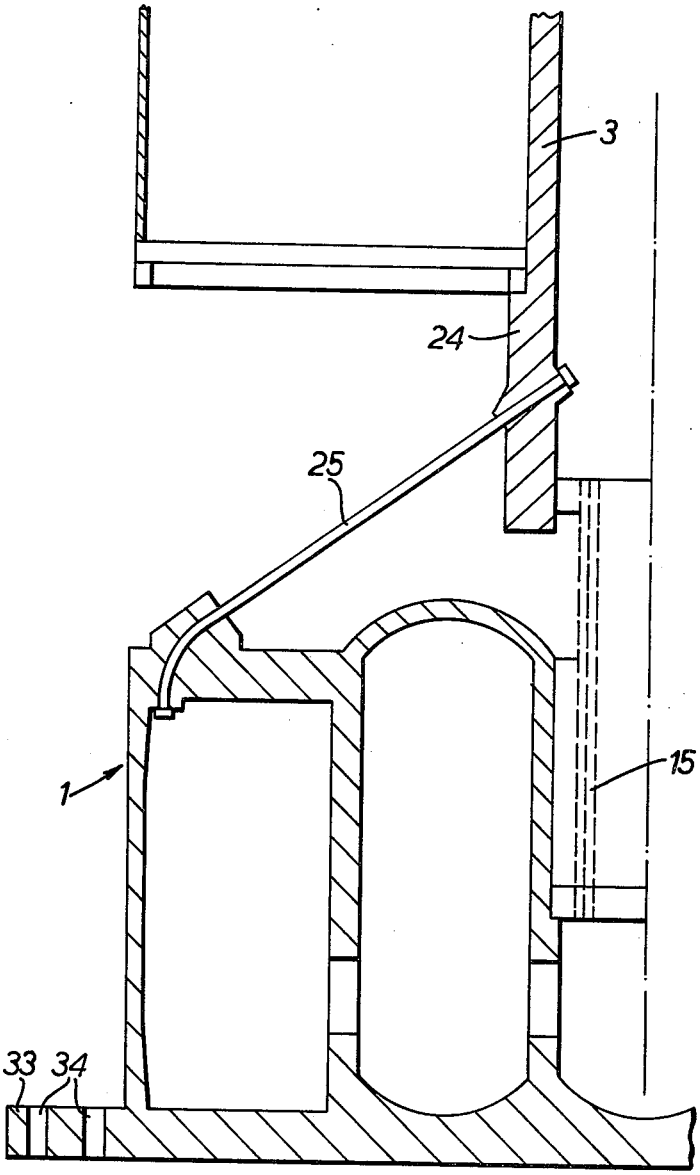

FIG. 10 shows a detail of the articulated joint formed by the tendons, and the flexible man-access connector 15 between the column section 3 and the base structure 1. The base structure is provided with a lower annular flange 33 having suitable holes 34 in which the piles 10 are located in the early stages and through which the piles are eventually driven.

As shown in FIGS. 8 and 10 the lower ends of the column sections 4 to 6 are bolted securely together for the transportation to the deep water site. For this purpose each column section has a radially outwardly directed bevelled flange 35 which mates with a corresponding radially inwardly directed bevelled flange 36 of the adjacent outer section to form a scarf abutment-shown in FIG. 10 - through which a bolt 37 extends to hold the sections firmly together. All the sections are held together in this way the section 4 being bolted directly to a hub portion 24 at the lower end of section 3. Thus during transportation the weight of the column sections is taken almost entirely by the buoyancy raft and not directly on the base structure 1.

Figure 12:
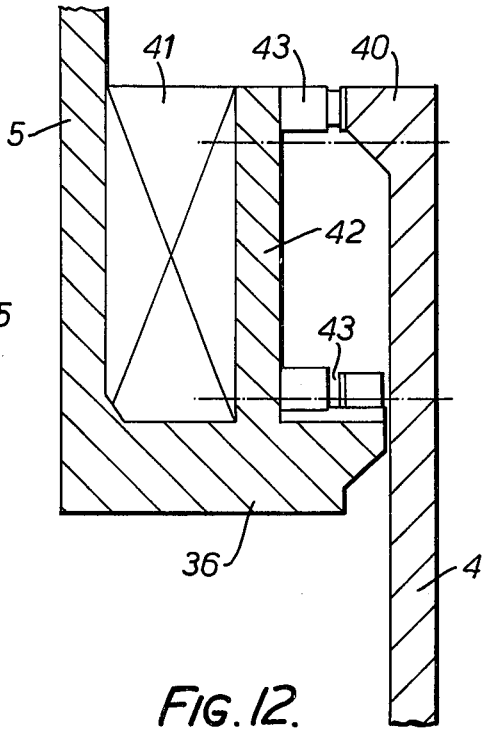

The formation of each joint between the column sections will be appreciated from FIG. 12. The upper end of the inner section, e.g. section 4 is shown, has an outer thickened rim 40 formed by an integrally cast ring of concrete. The flange 36 at the lower end of the adjacent section 5 carries an upwardly directed wall 42 located approximately half way between the cylindrical walls of the sections (4 and 5). Outside this wall 42 a number of radial web walls 41 are provided for strength.

When section 4 has been lowered to the correct position, sections 4 and 5 are held in that relative position by jacks 43 acting at the top and bottom of the annular gap bounded by the section 4, the radially inner part of the flange 36, the wall 42 and the rim 40. In one construction this gap is 2 ft wide in the radial direction and 19 ft deep. Fast setting prestressed, reinforced concrete is then formed in this gap to provide a rigid joint between the sections. The jacks 43 may subsequently be removed.

A particular advantage of the construction of a plurality of overlapping column sections to form the column is that if at the site the depth of water is found to be slightly different from the specification made at the planning stage, a slightly greater overlap (or perhaps a lesser overlap, though there will clearly be a minimum permissible one), can be made between the sections. If a greater overlap is wanted, a new reinforcing rim may have to be cast onto the section 4 to define the gap for the joining concrete.

This advantage is important because in planning the sites of production installations it is seldom possible to specify exactly the location and therefore the precise water depth, and the construction of the present invention makes it possible for changes in location and therefore in water depth at a very late stage to be accommodated without structural alterations.

This problem of specifying the precise location and water depth at an early stage in planning an installation is a major one and the construction according to the invention has the primary advantage that because of the provision of several column sections much greater flexibility of design specifications can be tolerated in the early days of construction; for example a water depth could be specified to within a wide margin of say 100 ft. The only affect of this in the initial construction is in the unspecified length (and possibly the number) of the intermediate column sections and thus much construction work may be completed before final specifications are needed, thus leaving more time for surveying and deciding on the final site. As mentioned, even when the equipment is actually made quite a substantial depth variation can be accepted by varying the degree of overlap. Clearly there will be a maximum possible depth for a given construction.

This it will be appreciated that of the variables concerned for the column sections, i.e. the quantity, the diameter and the lengths, only the length of the concrete tubes is really determined by the water depth. The diameter of the smallest section is determined by the diameter of the man-access connector 15 and the diameter of the largest section is found to be approximately the same for a wide variation of water depths. Between the smallest and largest diameter sections, a maximum number of intermediate tubes is possible determined by the fact that man-access space must be left between adjacent tubes to form the joints (about 6–7 ft on the radial width is required). The minimum space is shown between sections 3 and 4 in FIG. 8 but the space between sections 4 and 5, and 5 and 6 is twice as big and if a greater depth of column was needed, two extra tubes could be used in these larger gaps. Of course, if steel column sections are used, the number of column sections could be greater. Thus there is the added advantage that the same basic design and the same moulds for many components can be used for constructing equipment for installations for widely different water depths.

As mentioned above, the sections need not necessarily be parallel cylinders but could be tapered, and they may have tapering wall thicknesses along each section for different water depth and strength considerations. Moreover, there need not be an articulated joint between the base structure and the column; in some applications a rigid joint may be made. In the latter case an upwardly tapering column will probably be essential. This again can be achieved with the present invention by providing that the telescoped sections are lowered in order from the biggest diameter first, the smallest becoming the top.

Figure 11:
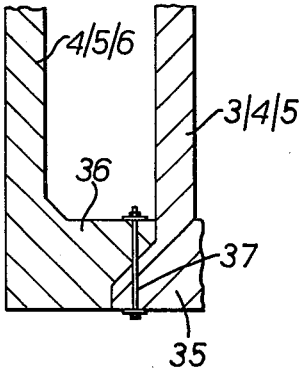

Furthermore, the base structure need not actually be fixed to the bottom but it may comprise a self buoyant structure designed to remain above the sea bed and anchored to the latter by anchor lines—see for example FIG. 11 of the complete specification of our cognate Patent Applications Nos. 5189/75 and 29895/75 and the corresponding descriptions.

As a further alternative, the column sections can be kept separate from the base structure until after the base structure and columns have been caused to sink, and thereafter secured to the base structure. The base structure can be directly anchored to the sea bed, or can be secured to a further structure already anchored to the sea bed.

The principle of using coaxial tubes makes possible various advantageous features. For example considering FIG. 1, a tower 50 may be provided inside the inner section 3 extending upwardly above it, for carrying services such as a lift, flexible power lines, pipework, risers etc. needed both during installation and in permanent operation. Moreover, the upwardly extending top part of the outer section 6 could be provided with prepositioned decks 51 or a stack of decks 52 could be arranged on the top of the tower 50, these decks 52 being automatically released at various levels on to receiving brackets on the inside of section 6 as the inner section 3 and the tower 50 move down.

This same feature of stacks of flat, annular decks could be provided on the top of each column section if the tops of the sections are designed to be at successive increased height with successively greater section diameter. Thus as each section moves down, the decks of each stack are released onto receiving brackets on the inside of the next section, at various levels; thus after all the column sections have been extended there will be working decks provided at various levels throughout the column.

Apart from the flexibility of the principle of using telscopic column sections as regards accommodating early and late changes in the specified water depth for installation, a further advantage lies in the fact that because the assembly, or at least the columns is/are transported to the deep water site as a complete telscoped unit, almost all of the necessary fitting out of the working platform 7 and the rest of the installation with the apparatus and servicing needed for eventual operation, can be carried out at the dry or shallow water sites in relative good conditions.

I claim:

1. A method of providing an installation for extracting oil or gas from under the sea bed at a deep water site, which installation comprises a base structure anchored to the sea bed so as to be below the surface and a column which extends from the base structure to above the surface, the column being in the form of a hollow pre-stressed concrete tube for accommodating conductors for oil or gas extending from the sea bed, through the base structure and the column to above the surface, the method comprising constructing at a dry or relatively shallow water site the base structure and at least two elongate hollow pre-stressed concrete column sections arranged telescopically one within the other and providing the base structure and the column sections with sufficient buoyancy for them to float; floating and transporting the base structure and the column sections to a deep water site; and sinking the base structure and in upright position one or more of the column sections successively relative to the column section that is next above it; joining the column sections to each other and to the base structure if not already so joined to form a column connected to the base structure, the joint between each two adjacent column sections comprising overlapping portions of these two sections defining an annular gap which is filled with fast setting cementacious material while the joint is still above the water level.

2. A method as claimed in claim 1, wherein the column sections are floated to the deep water site and sunk whilst separated from the base structure and thereafter joined to the base structure.

3. A method of providing an installation for extracting oil or gas from under the sea bed at the deep water site, which installation comprises a base structure anchored to the sea bed so as to be below the surface and a column which extends from the base structure to above the surface, the column being in the form of a hollow pre-stressed concrete tube for accommodating conductors for oil or gas extending from the sea bed, through the base structure and the column to above the surface, the method comprising constructing at a dry or relatively shallow water site the base structure and at least two elongate pre-stressed concrete hollow column sections arranged telescopically one within the other vertically oriented and disposed above the base structure; providing the base structure and the column sections with sufficient buoyancy for them to float in that relative disposition; floating and transporting the base structure and the column sections to a deep water site, sinking the base structure and in upright position one or more of the pre-stressed concrete column sections successively relative to the column section which is next uppermost; joining the column sections to each other to form a column connected to the base structure, the joint between each two adjacent column sections comprising overlapping portions of these two sections defining an annular gap which is filled with fast setting cementacious material while the joint is still above the water level; and anchoring the base structure to the sea bed.

4. A method as claimed in claim 1, wherein the base structure is directly anchored to the sea bed.

5. Equipment adapted to form an installation for extracting oil or gas from under the sea bed at a deep water site, the equipment comprising a base structure and at least two elongate hollow pre-stressed concrete column sections arranged telescopically, one within the other, the base structure and column sections being provided at a dry or relatively shallow water site at which they are constructed with sufficient bouoyancy for them to float, the column sections being adapted so that one or more of them can move down successively relative to an upper one and so that the column sections can be joined together at their end regions to form a column, the installation being placeable at a deep water site by floating and transporting the base structure and the pre-stressed concrete columns to this site from said dry or relatively shallow water site; sinking the base structure and in upright position one or more of the prestressed concrete column sections relative to the the pre-stressed concrete section that is uppermost; joining the pre-stressed concrete column sections to each other and to the base structure if not already so joined to form a column connected to the base structure, the joints between each two adjacent pre-stressed concrete column sections comprising overlapping portions of these two sections defining an annular gap which is filled with fast setting cementacious material while above the water level; and anchoring the base structure to the sea bed.

6. Equipment as claimed in claim 5, wherein the column sections are initially separate from the base structure for floating to the deep water site.

7. Equipment adapted to form an installation for extracting oil or gas from under the sea bed at a deep water site, the equipment comprising a base structure and at least two elongate hollow pre-stressed concrete column sections arranged telescopically, one with the other, vertically oriented and disposed above the base structure, the base structure and the pre-stressed concrete column sections being provided at a dry or relatively shallow water site at which they are constructed with sufficient buoyancy for them to float, the column sections being adapted so that one or more of them can move down relative to an upper one and so that the column sections can be joined together at their end regions to form a column; the installation being placeable at a deep water site by floating and transporting the base structure and the column sections to this site from said dry or relatively shallow water site; sinking the base structure and in upright position one or more of the pre-stressed concrete column sections relative to the column section which is uppermost; joining the column sections to each other to form a column connected to the base structure, the joint between each two adjacent column sections comprising overlapping portions of these two sections defining an annular gap which is filled with fast setting cementacious material; and anchoring the base structure to the sea bed, wherein the base structure, and column sections and the buoyancy are adapted so that during installation at the deep water site as each pre-stressed concrete column section is successively lowered relative to that which will be disposed above it in the final column, the joint which is made between the upper end region of the pre-stressed concrete column section just lowered and the lowered region of the next section can be made while above the water level.

8. Equipment as claimed in claim 5, wherein the column section that forms the top of the column carries a working platform.

9. Equipment as claimed in claim 5, wherein buoyancy is provided as a separate entity, the base structure and column sections being firmly attached to the buoyancy for transporation and, when at the deep water site, the buoyancy providing a working raft to remain at the water surface and support the base structure and column sections until such time as they are anchored or at least themselves floating in stable equilibrium, so that the buoyancy can be removed.

10. Equipment as claimed in claim 7, wherein the base structure contains floodable chambers to permit lowering the base structure and the or each successive column section relative to the upper column section to be achieved by introducing water into them to the required amount so that they just sink to the appropriate level.

11. Equipment as claimed in claim 7, wherein the tubes are cylindrical.

12. Equipment as claimed in claim 7, wherein the tubes are tapered.

13. Equipment as claimed in claim 7, wherein at the ends of the column sections there are protrusions that in the column extending condition are disposed relative to one another in a manner such as to facilitate the formation of concrete joints between the sections.

14. Equipment as claimed in claim 5, wherein the base structure is provided with piling equipment for driving piles to fix the base structure to the sea bed.

15. Equipment as claimed in claim 7, wherein the column sections are connected to the base structure via an articulated joint.

* * * * *